US009874331B2

(12) United States Patent
Shin et al.

(10) Patent No.: US 9,874,331 B2
(45) Date of Patent: Jan. 23, 2018

(54) AUTOMOTIVE HEADLAMP MODULE

(71) Applicant: Hyundai Motor Company, Seoul (KR)

(72) Inventors: Jik Soo Shin, Incheon (KR); Keon Soo Jin, Ulsan (KR); Jin Ho Na, Gyeonggi-do (KR); Ki Hong Lee, Seoul (KR); Byoung Suk Ahn, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 149 days.

(21) Appl. No.: 14/943,570

(22) Filed: Nov. 17, 2015

(65) Prior Publication Data

US 2017/0059111 A1 Mar. 2, 2017

(30) Foreign Application Priority Data

Aug. 28, 2015 (KR) ..... 10-2015-0121779

(51) Int. Cl.
*F21S 8/10* (2006.01)

(52) U.S. Cl.
CPC ..... *F21S 48/1794* (2013.01); *F21S 48/142* (2013.01); *F21S 48/145* (2013.01)

(58) Field of Classification Search
CPC ..... F21S 48/1794; F21S 48/142; F21S 48/145
See application file for complete search history.

(56) References Cited

U.S. PATENT DOCUMENTS 5,707,129 A * 1/1998 Kobayashi ..... B60Q 1/122 362/283

FOREIGN PATENT DOCUMENTS

| | | |
|---|---|---|
| JP | 2010-015693 A | 1/2010 |
| JP | 2010-086863 A | 4/2010 |
| JP | 2012-164656 | 8/2012 |
| KR | 10-2012-005027 | 5/2012 |
| KR | 10-2012-0050271 | 5/2012 |
| KR | 10-2012-007008 | 6/2012 |
| KR | 10-2012-0070081 | 6/2012 |
| KR | 10-2013-0082351 A | 7/2013 |

* cited by examiner

*Primary Examiner* — Sharon Payne
(74) *Attorney, Agent, or Firm* — Mintz Levin Cohn Ferris Glovsky and Popeo, P.C.; Peter F. Corless

(57) ABSTRACT

An automotive headlamp module thatreduces manufacturing cost and increases availability for low-cost vehicles is provided. The automotive headlamp provides a rotational force to a shield via a DC motor and improves safety during operation by implementing a beam pattern in a low-beam mode when performing a fail-safe function due to breakdown in a high-beam mode or an ADB mode. In particular, the automotive headlamp includes a drum type shield rotatably disposed with respect to a shield housing and has a high-beam protrusion, a low-beam protrusion, and an adaptive driving-beam (ADB) protrusion on an exterior side and a shield disc coupled to the shield that rotates. A housing disc guide is movable in a longitudinal direction of the shield by the shield housing and has an end in contact with the shield disc and a return spring and presses a housing disc to the shield disc with accumulated elastic force.

7 Claims, 12 Drawing Sheets

| BEAM MODE | STATE OF HEADLAMP MODULE | BEAM PATTERN |
|---|---|---|
| HIGH-BEAM MODE |   |   |
| FAIL-SAFE MODE WITH HIGH BEAM |  |   |
| LOW-BEAM MODE | |   |

| BEAM MODE | HIGH-BEAM MODE |
|---|---|
| STATE OF HEADLAMP MODULE |  |
| STATE OF SHIELD DISC AND HOUSING DISC |  |
| BEAM PATTERN |  |

AUTOMOTIVE HEADLAMP MODULE

CROSS REFERENCE TO RELATED APPLICATION

The present application claims priority to Korean Patent Application No. 10-2015-0121779, fried Aug. 28, 2015, the entire contents of which is incorporated herein for all purposes by this reference.

BACKGROUND

Field of the Invention

The present invention relates to an automotive headlamp module and, more particularly, to a module used at a low cost by simplifying components thereof and that implements a beam pattern in a low-beam mode when a fail-safe function is performed due to breakdown in a high-beam mode or an adaptive driving-beam mode.

Description of the Related Art

Generally, beam patterns formed by automotive headlamp modules are classified into a low-beam mode, a high-beam mode, and an adaptive driving-beam (e.g., ADB) mode. For example, the ADB mode, automatically adjusts the direction and angle of light based on the driving conditions, and is a technology that automatically adjusts into a high-beam mode and a low-beam mode by sensing a vehicle ahead using a an imaging device. Further, when another vehicle is disposed ahead of the vehicle, the ADB mode enables a driver to comfortably drive without blinding the driver by the light of an approaching vehicle.

A headlamp module of the related art, as show in FIGS. 1 and 2, includes a shield housing 1, a drum type shield 2 rotatably disposed within the shield housing 1, a shield motor 3 that produces power for operating the shield 2, a power transmission gear 4 that transmits power from the shield motor 3 to the shield 2, a PCB (Printed Circuit Board) 5 that has operates of the shield motor 3, a reflector 6 coupled to the shield housing 1, a light source 7 disposed on the reflector 6, an exterior case 8 that fixes the shield housing 1 and the reflector 6, and a case motor 9 coupled to the exterior case 8.

The shield 2 includes a high-beam protrusion 2*a*, a low-beam protrusion 2*b*, and an ADB protrusion 2*c* that protrudes radially. For example, when the shield 2 is rotated and the high-beam protrusion 2*a* is disposed ahead of the light source 7, a beam pattern of the high-beam mode is implemented. When the low-beam protrusion 2*b* is disposed ahead of the light source 7, a beam pattern of the low-beam mode is implemented. Further when the ADB protrusion 2*c* is disposed ahead of the light source 7, a beam pattern of the ADB mode is implemented.

The shield motor 3, is not a common direct current (e.g., DC) motor, but a stepping motor, that accurately adjusts a rotational angle of the shield 2, but has a disadvantage of high price. Moreover, a specific sensor 10 to detect a rotational position and a complex control logic is required, thereby making implementation difficult in common low-cost vehicles.

The case motor 9 is an Intelligent Smart Motor (ISM) that preforms a fail-safe function and the beam pattern in the high-beam mode or the ADB mode is higher than the beam pattern in the low-beam mode. For example, when a problem occurs with the shield motor 3 or the headlamp, the driver of an approaching vehicle may have their field of vision impacted thus potentially contributing to an accident. In other words, the case motor 9 is an ISM motor that communicates to recognize a breakdown mode. Upon recognition of a breakdown mode, the motor rotates the exterior case 8 to rotate the shield housing 1 and the reflector 6 coupled to the exterior case 8 downward, thereby adjusting the beam pattern from the headlamp to be lowered to the ground. However, when the headlamp module of the related art performs a fail-safe function in the high-beam mode or the ADB mode, the beam pattern in the high-beam mode or the beam pattern of the ADB mode is the beam pattern in the fail-safe mode.

Further, the beam pattern in the fail-safe mode does not cross over a cutoff line of a low beam, therefore the beam pattern in a fail-safe mode in the related art is formed in a downward direction substantially proximate to the ground. Additionally, performance deteriorates compared to a low beam state, thereby reducing safety during operation of the vehicle. When the beam pattern in the fail-safe mode crosses over the cutoff line of a low beam, the beam pattern becomes the same as the high-beam mode state, in which the driver's field of vision in an approaching vehicle is impacted. For example, FIG. 2 shows an exemplary beam pattern B1 in a high-beam mode, an exemplary beam pattern B2 in a fail-safe mode in a high-beam state, and an exemplary beam pattern B3 in a low-beam mode. The beam pattern B2 in the fail-safe mode is radiated lower than the beam pattern B3 in the low-beam mode, causing visual range of a driver to be significantly impacted and reduced.

The foregoing is intended merely to aid in the understanding of the background of the present invention, and is not intended to mean that the present invention falls within the purview of the related art that is already known to those skilled in the art.

SUMMARY

The present invention provides an automotive headlamp module that reduces manufacturing cost and that maybe used for common low-cost vehicles by implementing beam patterns in a high-beam mode, a low-beam mode, and an ADB mode, by simplifying components thereof and using low-cost components. Further, the present invention provides an automotive headlamp module that ensures a sufficient visual range for a driver and provides safety during operation of the vehicle by implementing a beam pattern in a low-beam mode upon engagement of a fail-safe function due to breakdown in a high-beam mode or an ADB mode.

In one aspect, according to an exemplary embodiment of the present invention, an automotive headlamp module may include a drum type shield rotatably disposed with respect to a shield housing and having a high-beam protrusion, a low-beam protrusion, and an ADB protrusion disposed on an exterior side. Further, a shield disc may be coupled to the shield to rotate with the shield and may have a rotational angle adjusted by the shield housing. A housing disc guided movable in a longitudinal direction of the shield by the shield housing and having an end in contact with the shield disc. Additionally, a return spring having both ends supported by the shield housing and the housing disc may press the housing disc to the shield disc utilizing the accumulated elastic force.

The automotive headlamp module may further include a direct current (DC) motor coupled to the shield housing that produces power to adjust the shield a PCB that may be coupled to the shield housing and may be configured to operate the DC motor and a power transmission gear that connects ends of the DC motor and the shield to each other and transmits power. The automotive headlamp module may further include a reflector coupled with the shield housing, a light source disposed on the reflector, an exterior case that couples the shield housing and the reflector and a case motor that couples the exterior case and provides power for rotating the exterior case to perform a fail-safe function.

An upper stopper and a lower stopper may be configured to adjust the rotational angle of the shield disc by coming in contact with the shield disc when the shield disc is rotated to be vertically arranged at a predetermined distance within the shield housing. The shield disc may include a shank coupled to the shield, that extends in a longitudinal direction of the shield, and inserted rotatably within the a shaft guide formed within the shield housing, and a male connector that extends in a longitudinal direction of the shank, disposed between the upper stopper and the lower stopper, and having a front side divided into a plurality (e.g., two) components by inclined surfaces that have about the same inclination. Further, a disc protrusion formed on the exterior side of the male connector and configured to adjust the rotational angle of the shield disc by coming in contact with the upper stopper and the lower stopper when the shield disc is rotated may be included.

In some exemplary embodiments, a disc guide into which the housing disc is inserted may be formed at a side (e.g., proximate to) the upper and lower stoppers within the shield housing. The housing disc may be restricted in rotation and translates in the longitudinal direction of the shield by the disc guide. The housing disc may include a rectangular parallel piped body that may be inserted in the disc guide, a male connector that protrudes toward the shield on a first side of the body and has a connector groove at a front side that fitted on the inclined surfaces of the male connector to contact the shield disc and a shank that extends in the longitudinal direction of the shield on a second side of the body and translates in the longitudinal direction of the shield through an exterior flange of the shield housing.

The return spring may be fitted on the shank of the housing disc, having a first end supported on the body of the housing disc and a second end supported on an interior side of the exterior flange of the shield housing.

In other exemplary embodiments, shapes of the inclined surfaces of the male connector and a shape of the connector groove of the female connector may coupled to each other, when the shield disc is rotated with the shield and the inclined surfaces of the male connector extends from the connector groove of the female connector. Further, the housing disc may translate in a linear trajectory from the shield disc against a force exerted by the return spring and with the housing disc translates away from the shield disc. Additionally, when the shapes of the inclined surfaces correspond to the shape of the connector groove or power supplied to the DC motor is disengaged, the housing disc may translate in a linear trajectory toward the shield disc by return force of the return spring and the shapes of the inclined surfaces and the shape of the connector groove may correspond to each other.

According to the vehicle headlamp module, rotational force may be applied to the shield by a common DC motor, compared to using a stepping motor, thereby providing a cost and component reduction. Accordingly, application of the headlamp module may be feasible for use in common low-cost vehicles. Further, according to an exemplary embodiment, a sufficient visual range for a driver even in an emergency may be provided and may provide enhanced safety during operation of the vehicle by implementing a beam pattern in a low-beam mode when a fail-safe function is performed due to breakdown in a high-beam mode or an ADB mode.

BRIEF DESCRIPTION OF THE DRAWINGS

The above and other objects, features and other advantages of the present invention will be more clearly understood from the following detailed description when taken in conjunction with the accompanying drawings.

DETAILED DESCRIPTION

Figure 1:
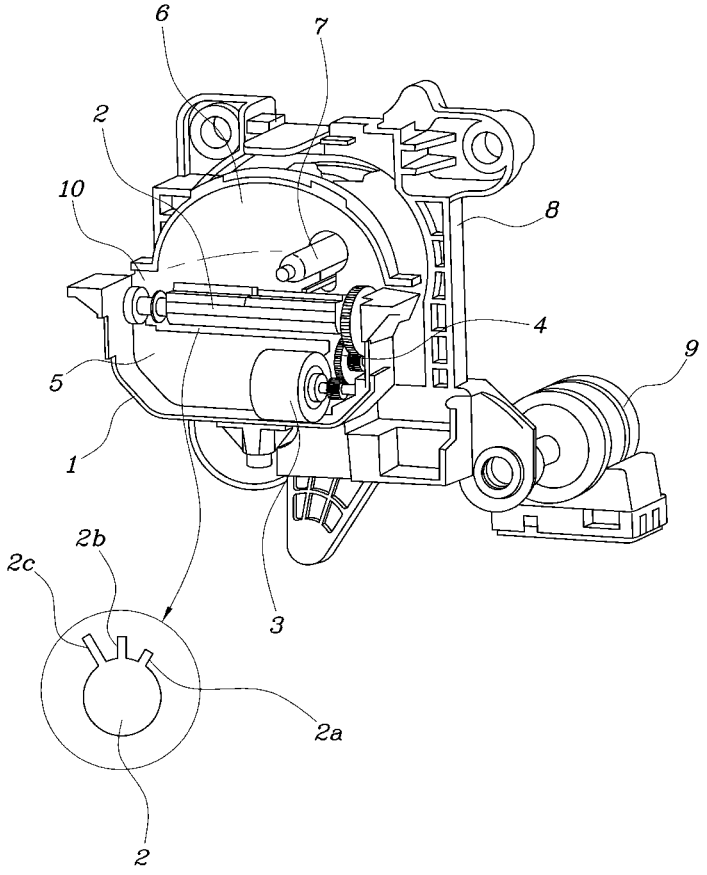
FIG. 1 (Related Art)
FIG. 1 is an exemplary view illustrating a headlamp module of the related art.
Figure 2:
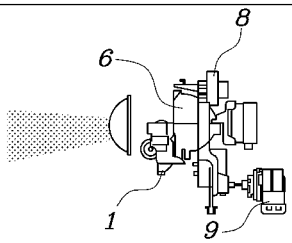
FIG. 2 (Related Art)
FIG. 2 is an exemplary view comparing a beam pattern in a fail-safe mode and a beam pattern in a low-beam mode that are implemented by a headlamp module of the related art.
Figure 2:
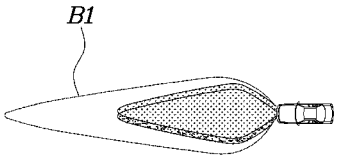
FIG. 2 (Related Art)
Figure 2:
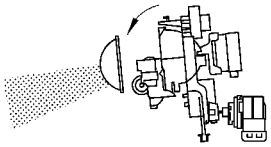
FIG. 2 (Related Art)
Figure 2:
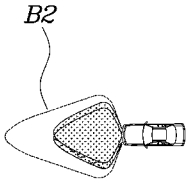
FIG. 2 (Related Art)
Figure 2:
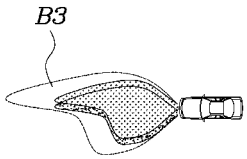
FIG. 2 (Related Art)
Figure 3:
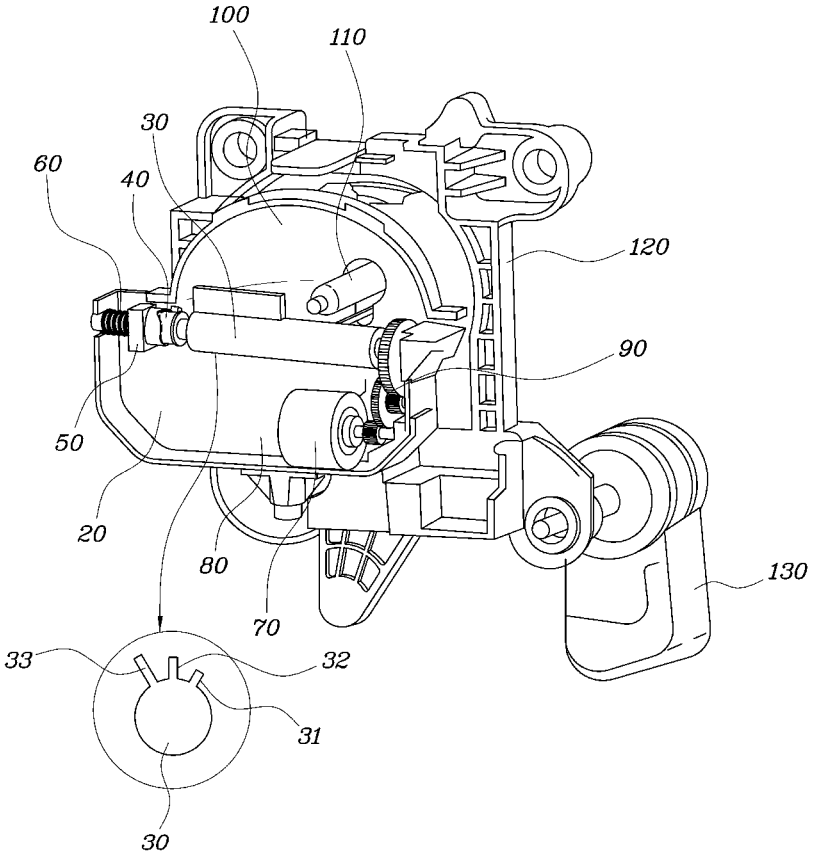
FIG. 3 is an exemplary perspective view of a headlamp module according to an exemplary embodiment of the present invention.
Figure 4:
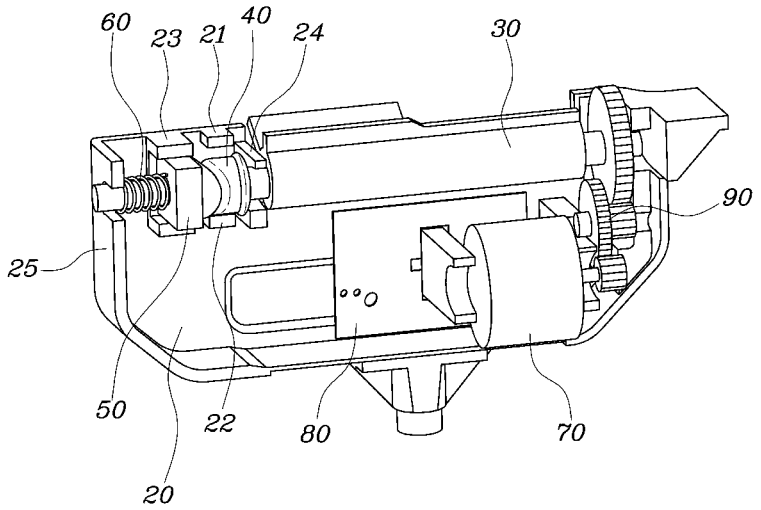
FIG. 4 is an exemplary view illustrating a configuration coupled to a shield housing shown in FIG. 3 according to an exemplary embodiment of the present invention.
Figure 5:
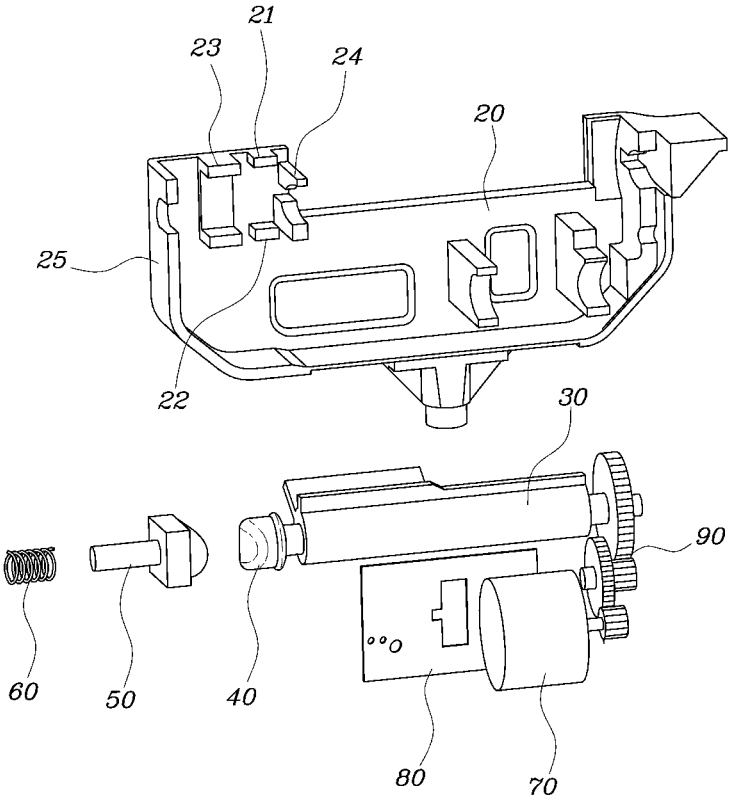
FIG. 5 is an exemplary exploded perspective view of FIG. 4 according to an exemplary embodiment of the present invention.
Figure 6:
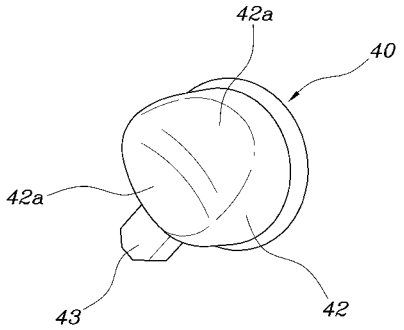
FIG. 6 is an exemplary perspective view, of a shield disc according to an exemplary embodiment of the present invention.
Figure 7:
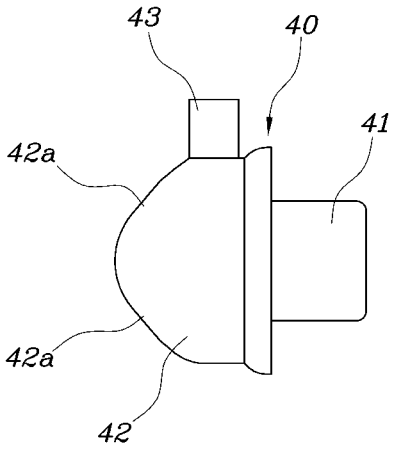
FIG. 7 is exemplary a plan view of a shield disc according to an exemplary embodiment of the present invention.
Figure 8:
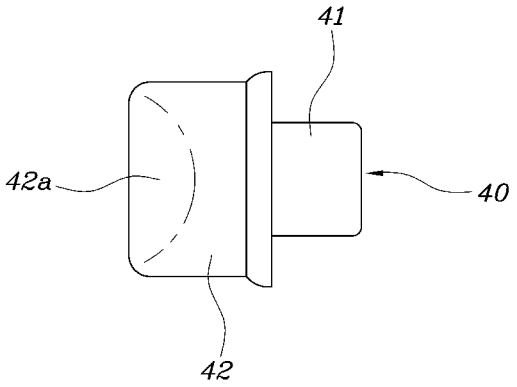
FIG. 8 is an exemplary side view of a shield disc according to an exemplary embodiment of the present invention.
Figure 9:
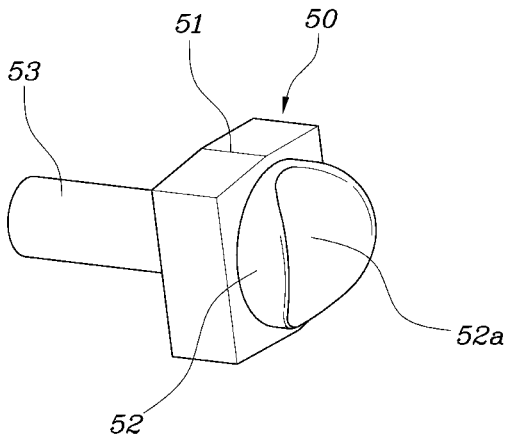
FIG. 9 is an exemplary perspective view of a housing disc according to an exemplary embodiment of the present invention.
Figure 10:
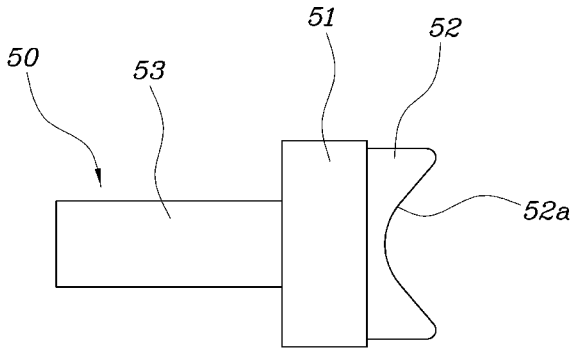
FIG. 10 is an exemplary a plan view of a housing disc according to an exemplary embodiment of the present invention.
Figure 11:
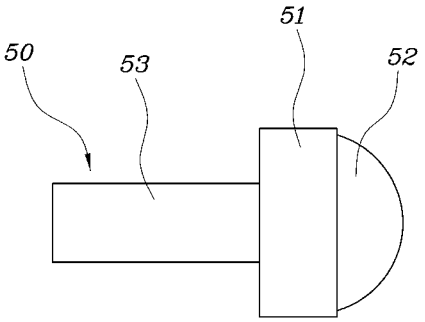
FIG. 11 is an exemplary side view of a housing disc according to an exemplary embodiment of the present invention.
Figure 12:
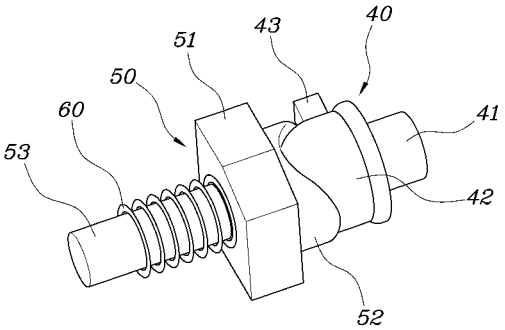
FIG. 12 is an exemplary a perspective view in which the shield disc and the housing disc are combined in accordance with an exemplary embodiment of the present invention.
Figure 13:
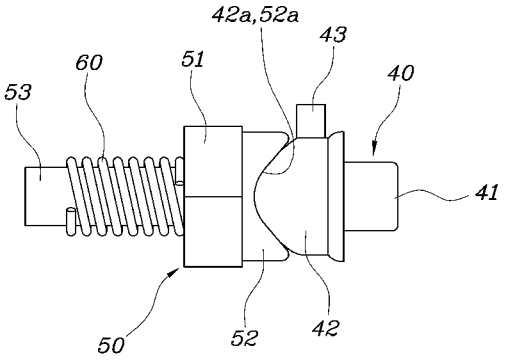
FIG. 13 an exemplary plan view in which the shield disc and the housing disc are combined in accordance with an exemplary embodiment of the present invention.
Figure 14:
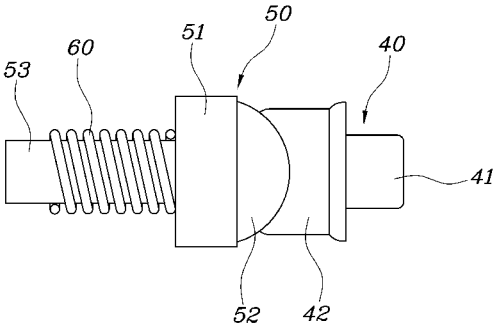
FIG. 14 is an exemplary side view in which the shield disc and the housing disc are combined in accordance with an exemplary embodiment of the present invention.

An automotive headlamp module according to exemplary embodiments of the present invention is described hereafter in detail with reference to the accompanying drawings. In the following detailed description, only certain exemplary embodiments of the present invention have been shown and described, simply by way of illustration. As those skilled in the art would realize, the described exemplary embodiments may be modified in various different ways, all without departing from the spirit or scope of the present invention. Accordingly, the drawings and description are to be regarded as illustrative in nature and not restrictive. Like reference numerals designate like elements throughout the specification.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. For example, in order to make the description of the present invention clear, unrelated parts are not shown and, the thicknesses of layers and regions are exaggerated for clarity. Further, when it is stated that a layer is "on" another layer or substrate, the layer may be directly on another layer or substrate or a third layer may be disposed therebetween.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum). An automotive headlamp module according to an exemplary embodiment of the present invention, as shown in FIGS. 3 to 17, may include a drum type shield 30 rotatably disposed with respect to a shield housing 20 and having a high-beam protrusion 31, a low-beam protrusion 32, and an ADB protrusion 33 on the exterior side; a shield disc 40 coupled to the shield 30 to rotate with the shield 30 and having a rotational angle adjusted by the shield housing 20, and a housing disc 50 guided to translate in the longitudinal direction of the shield 30 by the shield housing 20 and having an end being in contact with the shield disc 40; and a return spring 60 having both ends supported by the shield housing 20 and the housing disc 50 that press the housing disc 50 to the shield disc 40 with accumulated elastic force.

The present invention may further include a DC motor 70 fixed to the shield housing 20 configured to produce power to translate the shield 30, a PCB 80 coupled to the shield housing 20 and configured to operate the DC motor 70, and a power transmission gear 90 connecting ends of the DC motor 70 and the shield 30 that transmit power. Further, included may be a reflector 100 coupled to the shield housing 20; a light source 110 disposed on the reflector 100, an exterior case 120 that couples the shield housing 20 and the reflector 100 and a case motor 130 coupled to the exterior case 120 and provides power for rotating the exterior case 120 to perform a fail-safe function.

In particular, when the shield 30 is rotated and the high-beam protrusion 31 is disposed ahead of the light source 110, a beam pattern in a high-beam mode may be implemented, when the low-beam protrusion 32 is disposed ahead of the light source 110, a beam pattern in the low-beam mode may be implemented, and when the ADB protrusion 33 is disposed ahead of the light source 110, a beam pattern in an ADB mode may be implemented. The present invention may provide a rotational force to the shield 30 from the common DC motor 70, and advantageously reduces the manufacturing cost in comparison to using a stepping motor for a shield motor in the related art. Further, the present invention does not require a specific sensor or a complex control logic, as required by the related art, to detect the rotational position of the shield 30, since it uses the DC motor 70. Accordingly the cost may be reduced thereby making the technology feasible for use in common low-cost vehicles.

The case motor 130 may be an Intelligent Smart Motor (ISM) configured to preform a fail-safe function and the beam pattern in the high-beam mode or the ADB mode may be higher than the beam pattern in the low-beam mode. For example, when a problem occurs (e.g., an error or a failure) with the DC motor 70 or the headlamp, the driver of an approaching vehicle may have a field of vision obstructed (e.g., blinded) thus possibly contributing to an accident In other words, the case motor 130 may be an ISM motor that may communicate to recognize a breakdown mode. Upon recognition of a breakdown mode, the exterior case 120 may be rotated and the shield housing 20 and the reflector 110 equipped with the light source 110, coupled to the exterior case 120, may be rotated downward. Thus the beam pattern from the headlamp may be lowered to the ground.

According to headlamp modules of the related art, when a fail-safe function is performed in a high-beam mode or an ADB mode, the beam pattern in the high-beam mode or the beam pattern in the ADB mode is the beam pattern in a fail-safe mode and the beam pattern in the fail-safe mode is not supposed cross over a cutoff of a low beam, is the beam pattern is formed proximate to the ground. Accordingly, in the headlamp modules of the related art, performance is reduced in the beam pattern in the fail-safe mode in comparison to the beam pattern in the low-beam mode.

However, according to an exemplary embodiment of the present invention, since the beam pattern in the low-beam mode may be implemented upon performance of the fail-safe function due to breakdown in the high-beam mode or the ADB mode by the shield disc 40, housing disc 50, and return spring 60, and the shield housing 20 receiving them, a sufficient visual range for a driver and safety during operation of the vehicle may be ensured. In other words, an upper stopper 21 and a lower stopper 22 configured to adjust the rotational angle of the shield disc 40 by coming in contact with the shield disc 40 when the shield disc 40 is rotated are vertically arranged at a predetermined distance within the shield housing 20 and a disc guide 23 into which the housing disc 50 may be formed at a side from the upper and lower stoppers 21 and 22. Accordingly, the disc guide 23 may prevent rotation of the housing disc 50, and the housing disc 50 may translate in the longitudinal direction of the shield 30. Namely, the disc guide 23 may be formed in a U-shape with a side open, but is not limited thereto.

The shield disc 40 may include a shank 41 coupled to the shield 30, that extends in the longitudinal direction of the shield 30, and may be inserted rotatably in the shaft guide 24 formed in the interior of the shield housing 20. A male connector 42 may extend in the longitudinal direction of the shank 41, may be disposed between the upper stopper 21 and the lower stopper 22, and may have a runt side divided into a plurality (e.g., two) components by inclined surfaces 42*a* having about the same inclination; and a disc protrusion 43 may be formed on the exterior side of the male connector 42 and may be configured to adjust the rotational angle of the shield disc 40 by contact with the upper stopper 21 and the lower stopper 22 upon rotation of the shield disc 40.

The housing disc 50 may include a rectangular parallel piped body 51 inserted in the disc guide 23, a male connector 52 that protrudes toward the shield 30 on a first side of the body 51 and having a connector groove 52*a* at the front side fitted on the inclined surfaces 42*a* of the male connector 42 to contact with the shield disc 40 and a shank 53 that extends in the longitudinal direction of the shield 30 on a second side of the body 51 and translates in the longitudinal direction of the shield 30 through an exterior flange 25 of the shield housing 20. The return spring 60 may be coupled to the shank 53 of the housing disc 50, with a first end supported on the body 51 of the housing disc 50 and a second end supported on the interior side of the exterior flange 25 of the shield housing 20.

Figure 15:
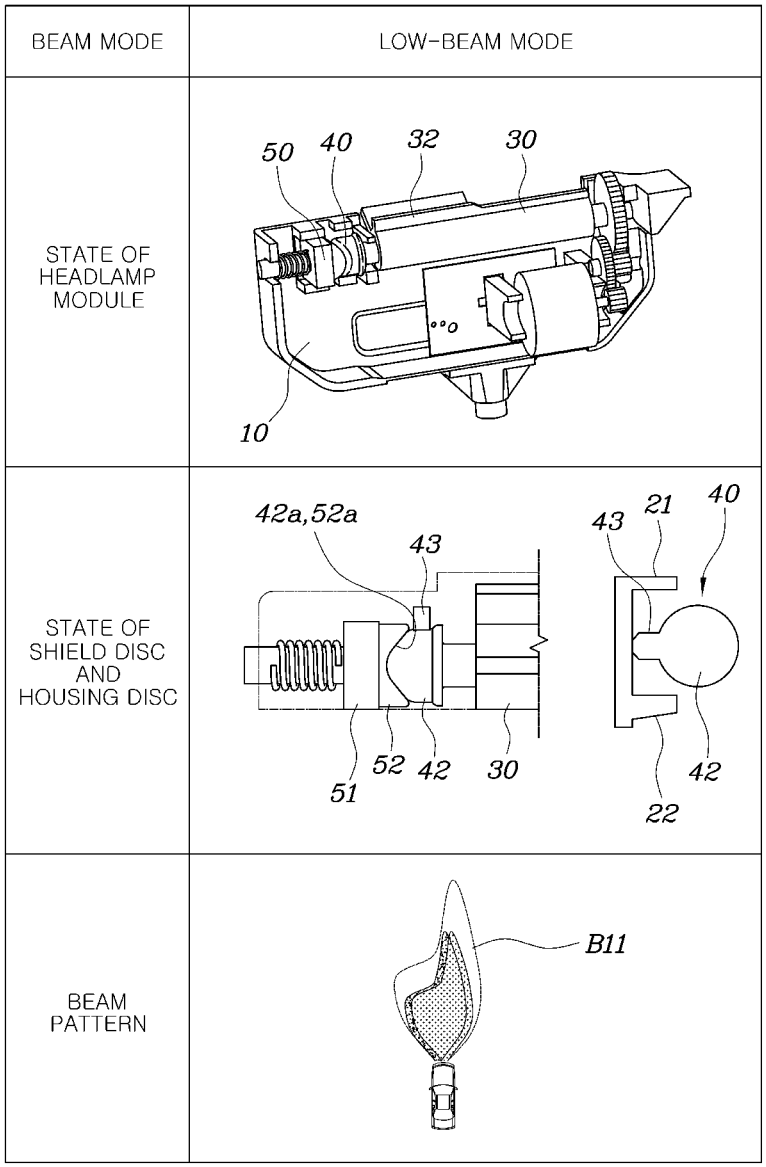
FIG. 15 is an exemplary view illustrating a beam pattern in a low-beam mode implemented by the headlamp module of an exemplary embodiment of the present invention.

The operation of an exemplary embodiment of the present invention is described hereafter. FIG. 15 shows a low-beam mode in which a beam pattern B11 of a low-beam mode may be implemented with the low-beam protrusion 32 on the shield 30 disposed ahead of the light source 110. For example, the shield disc 40 and the housing disc 50 may be coupled with the inclined surfaces 42*a* of the male connector 42 fully inserted in the connector groove 52*a* of the male connector 52 and the shapes of the inclined surfaces 42*a* may correspond to the shape of the connector groove 52*a*, and the disc protrusion 43 of the shield disc 40 may be disposed between the upper and lower stoppers 21 and 22.

Figure 16:
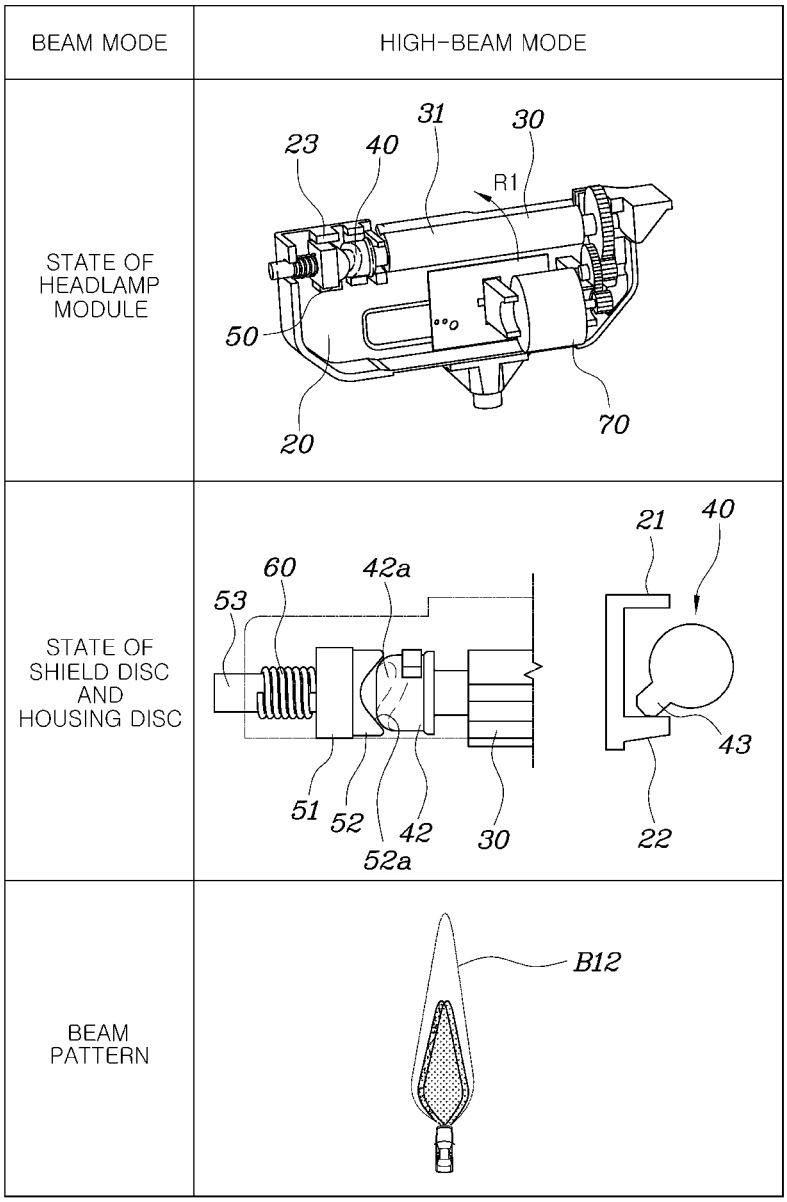
FIG. 16 is an exemplary view illustrating a beam pattern in a high-beam mode, implemented by the headlamp module of an exemplary embodiment of the present invention.

FIG. 16 shows a high-beam mode in which a beam pattern B12 in a high-beam mode may be implemented with the high-beam protrusion 31 on the shield 30 disposed ahead of the light source 110. For example, when the shield 30 is rotated in the direction of an arrow R1 by the DC motor 70 in the low-beam mode shown in FIG. 15, the high-beam protrusion 31 advances ahead of the light source 110 and the beam pattern B12 in the high-beam mode may be implemented. The shield disc 40 may be rotated with the shield 30 and the inclined surfaces 42*a* of the male connector 42 that extends from the connector groove 52*a* of the female connector 52 and the housing disc 50 may be translated (e.g., moved or pushed) by the shield disc 40, to cause the housing disc 50 to translate in a linear trajectory (e.g., straight) away from the shield disc 40 against the force by the return spring 60. When the housing to disc 50 translates to a farthest position away from the shield disc 40, the disc protrusion 43 of the shield disc 40 contacts the lower stopper 22, and rotation of the shield 30 may be restricted.

Figure 17:
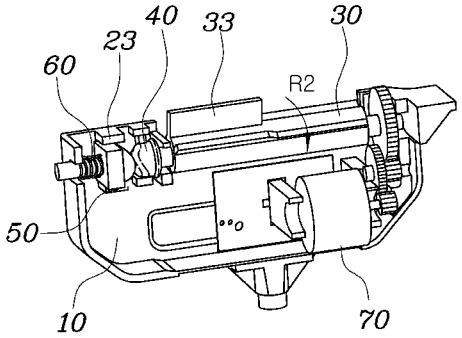
FIG. 17 is an exemplary view illustrating a beam pattern in an ADB mode implemented by the headlamp module of an exemplary embodiment of the present invention.
Figure 17:
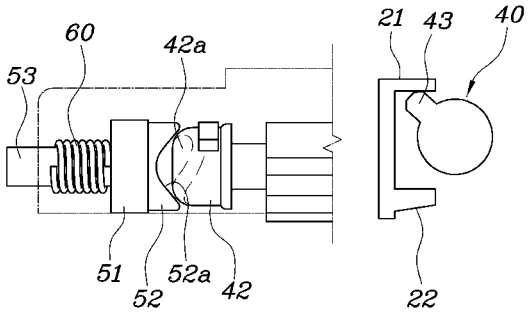
Figure 17:
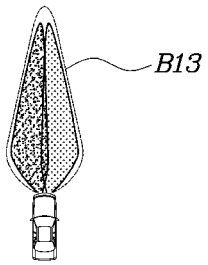

FIG. 17 shows a high-beam mode in which a beam pattern B13 in an ADB mode may be implemented with the ADB protrusion 33 on the shield 30 disposed ahead of the light source 110. For example, the shield 30 may be rotated in the direction of an arrow R2 by the DC motor 70 in the low-beam mode shown in FIG. 15, the ADB protrusion 33 may advance ahead of the light source 110 and the beam pattern B13 in the ADB mode may implemented. The shield disc 40 may be rotated with the shield 30 and the inclined surfaces 42*a* of the male connector 42 that may extend from the connector groove 52*a* of the female connector 52 and the housing disc 50 may translate (e.g., be moved or pushed) by the shield disc 40, and the housing disc 50 translates in a linear trajectory away from the shield disc 40 against the force by the return spring 60. When the housing disc 50 is moved farthest away from the shield disc 40, the disc protrusion 43 of the shield disc 40 may contact with the upper stopper 21, to restrict rotation of the shield 30 may be restricted.

Furthermore, when the DC motor 70 or the driving system for the headlamp breaks in the high-beam mode or the ADB mode, as in FIG. 16 or 17, the case motor 130 that is an ISM (Intelligent Smart Motor) may be configured to rotate the exterior case 120 and the shield housing 20 connected to the exterior case 120. The reflector 100 equipped with the light source 110 may be rotated downward, and a fail-safe function that lowers the beam pattern from the headlamp to the ground may be performed.

Moreover, when the power supplied to the DC motor 70 is disengaged with the fail-safe function, the housing disc 50 that has translated to the farthest position from the shied disc 40 may be translated in a linear trajectory toward the shield disc 40 by the return force of the return spring 60. Additionally the shield disc 40 and the housing disc 50 may be coupled to each other with the inclined surfaces 42*a* of the male connector 42 fully inserted within the connector groove 52*a* of the male connector 52. The shapes of the inclined surfaces 42*a* correspond to the shape of the connector groove 52*a*, and the disc protrusion 43 of the shield disc 40 may be disposed between the upper and lower stoppers 21 and 22. Accordingly, in the headlamp module of the present invention, the low-beam protrusion 32 on the shield 30 may be disposed ahead of the light source 110, the beam pattern B11 in the low-beam mode shown in FIG. 15 may be implemented when the fail-safe function is performed.

As described above, as the beam pattern B11 in the low-beam mode may be implemented when the fail-safe function is performed due to breakdown in the high-beam mode or the ADB mode. Additionally a sufficient visual range may be ensured for a driver even in an emergency, so safety the vehicle may be safely operated.

Although an exemplary embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. An automotive headlamp module, comprising:

a drum type shield rotatably disposed with respect to a shield housing and having a high-beam protrusion, a low-beam protrusion, and an adaptive driving-beam (ADB) protrusion on an exterior side thereof;

a shield disc coupled to the shield to rotate with the shield and having a rotational angle adjusted by the shield housing;

a housing disc guided movable in a longitudinal direction of the shield by the shield housing and having an end in contact with the shield disc; and a return spring having both ends supported by the shield housing and the housing disc and pressing the housing disc to the shield disc with accumulated elastic force, wherein an upper stopper and a lower stopper configured to adjust the rotational angle of the shield disc by coming in contact with the shield disc when the shield disc is rotated are arranged vertically at a predetermined distance within the shield housing, and wherein the shield disc includes;

a shank coupled to the shield, that extends in a longitudinal direction of the shield, and rotatably inserted in the a shaft guide formed within an interior of the shield housing;

a male connector that extends in a longitudinal direction of the shank, disposed between the upper stopper and the lower stopper, and having a front side divided into a plurality of components by inclined surfaces having about the same inclination; and a disc protrusion formed on the exterior side of the male connector and configured to adjust the rotational angle of the shield disc by contact with the upper stopper and the lower stopper via rotation of the shield disc.

2. The automotive headlamp module of claim 1, further comprising:

a direct current (DC) motor coupled to the shield housing and configured to produce power to drive the shield;

a printed circuit board (PCB) coupled to the shield housing and configured to control operation of the DC motor; and a power transmission gear that connects ends of the direct current motor and the shield to each other and is configured to transmit power.

3. The automotive headlamp module of claim 1, further comprising:

a reflector coupled to the shield housing;

a light source disposed on the reflector;

an exterior case that couples the shield housing and the reflector; and a case motor coupled to the exterior case and in response to a failure is configured to provide power for rotating the exterior case to perform a fail-safe function.

4. The automotive headlamp module of claim 1, wherein a disc guide in which the housing disc is inserted is formed proximate to the upper and lower stoppers within the interior of the shield housing, and the housing disc is restricted in rotation and translates in the longitudinal direction of the shield by the disc guide.

5. The automotive headlamp module of claim 4, wherein the housing disc includes:

a rectangular parallel piped body inserted into the disc guide;

a male connector that protrudes toward the shield on a first side of the body and a connector groove disposed at a front side coupled to the inclined surfaces of the male connector to contact the shield disc; and a shank that extends in the longitudinal direction of the shield on a second side of the body and translates in the longitudinal direction of the shield via an exterior flange of the shield housing.

6. The automotive headlamp module of claim 5, wherein the return spring is coupled to the shank of the housing disc, with a first end supported on the body of the housing disc and a second end supported on an interior side of the exterior flange of the shield housing.

7. The automotive headlamp module of claim 5, wherein with shapes of the inclined surfaces of the male connector and a shape of the connector groove of the female connector are coupled to each other, when the shield disc is rotated with the shield and the inclined surfaces of the male connector extends from the connector groove of the female connector, the housing disc translates in a linear trajectory from the shield disc against force by the return spring; and wherein the housing disc translates farthest away from the shield disc, when the shapes of the inclined surfaces fit to the shape of the connector groove or power supplied to the direct current motor is disengaged, the housing disc translates linearly toward the shield disc by return force of the return spring and the shapes of the inclined surfaces and the shape of the connector groove that correspond to each other.

* * * * *